US010227163B2

(12) United States Patent
Tseng et al.

(10) Patent No.: US 10,227,163 B2
(45) Date of Patent: Mar. 12, 2019

(54) AUDIBLE SLIDABLE ZIPPER BAGS

(71) Applicant: Inteplast Group, Ltd., Livingston, NJ (US)

(72) Inventors: Ben Tseng, East Brunswick, NJ (US); Jyh-yao Raphael Li, Parsippany, NJ (US); Kelvin Yang, Madison, NJ (US)

(73) Assignee: Interplast Group Corporation, Livingston, NJ (US)

( * ) Notice: Subject to any disclaimer, the term of this patent is extended or adjusted under 35 U.S.C. 154(b) by 39 days.

(21) Appl. No.: 14/839,211

(22) Filed: Aug. 28, 2015

(65) Prior Publication Data

US 2016/0059997 A1 Mar. 3, 2016

Related U.S. Application Data

(60) Provisional application No. 62/043,948, filed on Aug. 29, 2014.

(51) Int. Cl.
*B65D 33/25* (2006.01)
*B65D 33/00* (2006.01)

(52) U.S. Cl.
CPC ..... *B65D 33/2591* (2013.01); *B65D 33/004* (2013.01); *B65D 2203/12* (2013.01)

(58) Field of Classification Search
CPC ..... B65D 33/25; B65D 33/2508; B65D 33/2516; B65D 33/2525; B65D 33/2533; B65D 33/2541; B65D 33/255; B65D 33/2558; B65D 33/2566; B65D 33/2591
USPC ..... 383/61.1, 63–65
See application file for complete search history.

(56) References Cited

U.S. PATENT DOCUMENTS

| | | | | |
|---|---|---|---|---|
| 4,892,414 | A | 1/1990 | Ausnit | |
| 5,351,369 | A | 10/1994 | Swain | |
| 5,689,866 | A | 11/1997 | Kasai et al. | |
| 5,722,128 | A | 3/1998 | Toney et al. | |
| 6,854,886 | B2 | 2/2005 | Piechocki et al. | |
| 8,196,269 | B2 | 6/2012 | Dais et al. | |
| 2005/0280181 | A1* | 12/2005 | Turvey | B65D 33/2591 264/284 |
| 2005/0281492 | A1* | 12/2005 | Turvey | B65D 33/2591 383/64 |
| 2007/0193000 | A1* | 8/2007 | Cameron | A44B 19/267 24/30.5 R |
| 2008/0285894 | A1* | 11/2008 | Stolmeier | B65D 33/2591 383/64 |

(Continued)

*Primary Examiner* — Nathan J Newhouse
*Assistant Examiner* — Nina K Attel
(74) *Attorney, Agent, or Firm* — Stinson Leonard Street LLP

(57) ABSTRACT

A plastic bag has a closure comprising first and second mutually interlocking profiles and a slider on the closure adapted to engage the interlocking profiles in locking relationship when the slider is moved across the profiles in a locking direction and to disengage the interlocking profiles when the slider is moved across the profiles in an opening direction opposite the locking direction. Topographical features are spaced periodically along the width of the closure. The topographical features are arranged for engagement with the slider as the slider moves across the profiles. Engagement between the topographical features and the slider produces a locking tactile and audible sensation upon closing the closure which is different from an opening tactile and audible sensation upon opening the closure.

6 Claims, 8 Drawing Sheets

(56) References Cited

U.S. PATENT DOCUMENTS

| | | | | |
|---|---|---|---|---|
| 2010/0170900 | A1* | 7/2010 | Roger | B65D 33/2591<br>220/324 |
| 2012/0027322 | A1* | 2/2012 | Ackerman | A44B 19/16<br>383/64 |
| 2013/0287322 | A1 | 10/2013 | Gong | |

* cited by examiner

AUDIBLE SLIDABLE ZIPPER BAGS

REFERENCE TO RELATED APPLICATION

This application claims priority to U.S. provisional application 62/043,948 filed Aug. 29, 2014, the entire disclosure of which is expressly incorporated herein by reference.

FIELD OF THE INVENTION

The present invention relates to plastic bags for storage such as food and other storage bags having a zipper-type closure.

BACKGROUND

U.S. Pat. No. 5,722,128 discloses a plastic storage bag which has a reclosable zipper assembly which provides audible and tactile feedback upon opening and closing the zipper. The top edges of the bag have profiles which have periodic notches or otherwise alternating deformed and undeformed segments which interact with a slider used to close and open the zipper. The interaction manifests itself as a bumpy feeling and as a clicking sound upon opening and closing the bag, thus providing a tactile and audible sensation upon opening the bag which is similar to a tactile and audible sensation upon closing the bag.

SUMMARY OF THE INVENTION

It is an object of this invention to provide a plastic bag with a zipper-type closure which provides a tactile and audible sensation upon closing the bag; and to provide such a bag which provides a significantly different tactile and audible sensation upon opening the bag.

Briefly, therefore, the invention is directed to a plastic bag having a closure comprising first and second mutually interlocking profiles and a slider on the closure adapted to engage the interlocking profiles in locking relationship when the slider is moved across the profiles in a locking direction and to disengage the interlocking profiles when the slider is moved across the profiles in an opening direction opposite the locking direction; wherein the bag has a locking tactile and audible sensation upon closing the closure which is different from an opening tactile and audible sensation upon opening the closure.

In one aspect, the invention is directed to a plastic bag having a first panel and a second panel which define a bag interior and an opening at an end margin of the first and second panels to permit access to the bag interior; a closure at the opening comprising first and second mutually interlocking profiles on the first and second panels, respectively; a slider on the closure adapted to engage the interlocking profiles in locking relationship when the slider is moved across the profiles in a locking direction and to disengage the interlocking profiles when the slider is moved across the profiles in an opening direction opposite the locking direction; a constrictor on the slider for forcing the interlocking profiles together upon sliding the slider in the locking direction; a spreader on the slider for spreading the interlocking profiles apart upon sliding the slider in the opening direction; a plurality of topographical features spaced periodically along at least one of the profiles which features interfere with sliding of the slider across the profiles and thereby provide a tactile and audible sensation of interference upon sliding;

wherein one or both of the constrictor and spreader are configured so the sliding in the locking direction provides a locking tactile and audible sensation which is different from an opening tactile and audible sensation upon sliding in the opening direction.

In another aspect the invention is directed to a plastic bag comprising a first panel; a second panel, the first panel and second panel defining a bag interior and an opening at an end margin of the first and second panels to permit access to the bag interior; a closure at the opening comprising first and second mutually interlocking profiles on the first and second panels, respectively, each of the first and second profiles having an outwardly facing surface, the outwardly facing surfaces of the first and second profiles defining a width of the closure when the first and second profiles are in mutually interlocking engagement with one another; a slider on the closure adapted to engage the interlocking profiles in locking relationship when the slider is moved across the profiles in a locking direction and to disengage the interlocking profiles when the slider is moved across the profiles in an opening direction opposite the locking direction; a constrictor on the slider for forcing the interlocking profiles together upon sliding the slider in the locking direction, the constrictor defining a gap having a constrictor width that is larger than the closure width; a spreader on the slider for spreading the interlocking profiles apart upon sliding the slider in the opening direction;

a plurality of topographical features spaced periodically along the outwardly facing surface of at least one of the profiles in opposing relationship with the constrictor, engagement between the topographical features and the constrictor when the slider slides across the profiles in the locking direction providing a locking tactile and audible sensation and engagement between the topographical features and the constrictor when the slider slides across the profiles in the opening direction providing an opening tactile and audible sensation, the opening tactile and audible sensation being muted relative to the locking tactile and audible sensation.

The invention is also directed to a plastic bag comprising a first panel; a second panel, the first panel and second panel defining a bag interior and an opening at an end margin of the first and second panels to permit access to the bag interior; a closure at the opening comprising first and second mutually interlocking profiles on the first and second panels, respectively, each of the first and second interlocking profiles having an inner surface; a slider on the closure adapted to engage the interlocking profiles in locking relationship when the slider is moved across the profiles in a locking direction and to disengage the interlocking profiles when the slider is moved across the profiles in an opening direction opposite the locking direction; a constrictor on the slider for forcing the interlocking profiles together upon sliding the slider in the locking direction; a spreader on the slider for spreading the interlocking profiles apart upon sliding the slider in the opening direction, the spreader having opposite first and second side walls opposing and engaging the inner surfaces of the first and second interlocking profiles, respectively, each of the first and second side walls defining a rounded edge facing the opening direction and a sharp edge facing the locking direction; a plurality of topographical features spaced periodically along the inner surface of at least one of the first and second profiles in opposing relationship with at least one of the respective side walls of the spreader, engagement between the topographical features and the sharp edge of the spreader when the slider slides across the profiles in the locking direction providing a locking tactile and audible sensation and engagement between the topographical features and the rounded edge of the spreader when the slider slides across the profiles in the opening direction providing an opening tactile and audible sensation, the opening tactile and audible sensation being muted relative to the locking tactile and audible sensation.

Other objects and features will be in part apparent and in part pointed out hereinafter.

BRIEF DESCRIPTION OF THE DRAWINGS

Corresponding parts are given corresponding reference numbers throughout the drawings.

DETAILED DESCRIPTION OF PREFERRED EMBODIMENTS

Figure 1:
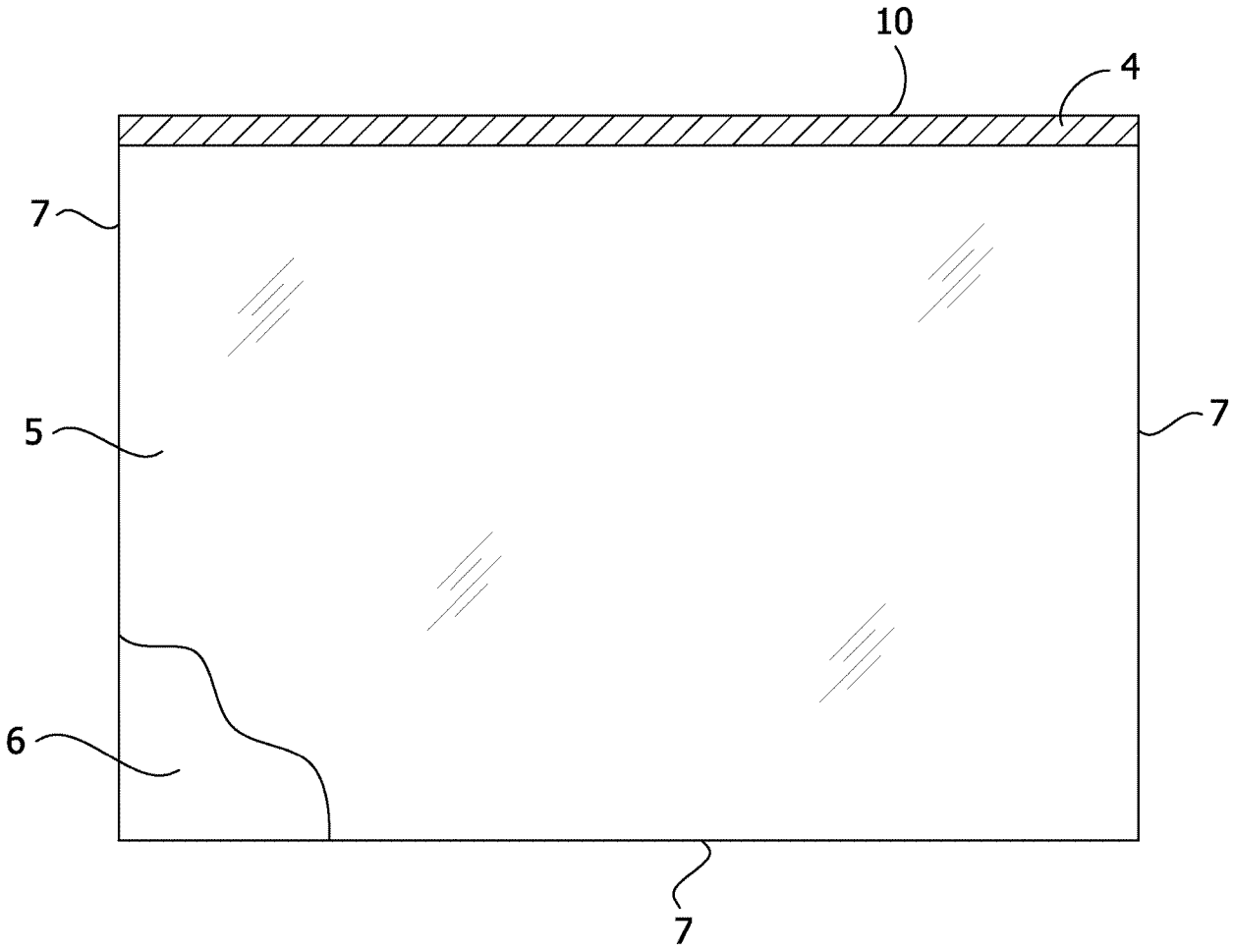
FIG. 1 is a fragmentary schematic front elevation of a bag.

The invention is directed to a plastic bag which comprises two abutting flat panels having an opening at one edge and sealed along other edges, such as two rectangular panels sealed along three edges with an opening at the fourth edge. In one preferred embodiment, there is a first panel and a second panel, wherein the first panel and second panel define a bag interior and an opening at an end margin of the first and second panels to permit access to the bag interior. These are shown in the front view in FIG. 1 as two rectangular panels 5, 6, sealed along three edges 7, 8, and 9 with an opening at the fourth edge 10. For purpose of illustration only, the lower left corner of first panel 5 is shown removed in phantom so that second panel 6 is visible. There is a zipper-type closure 4 shown schematically at the opening.

Figure 2:
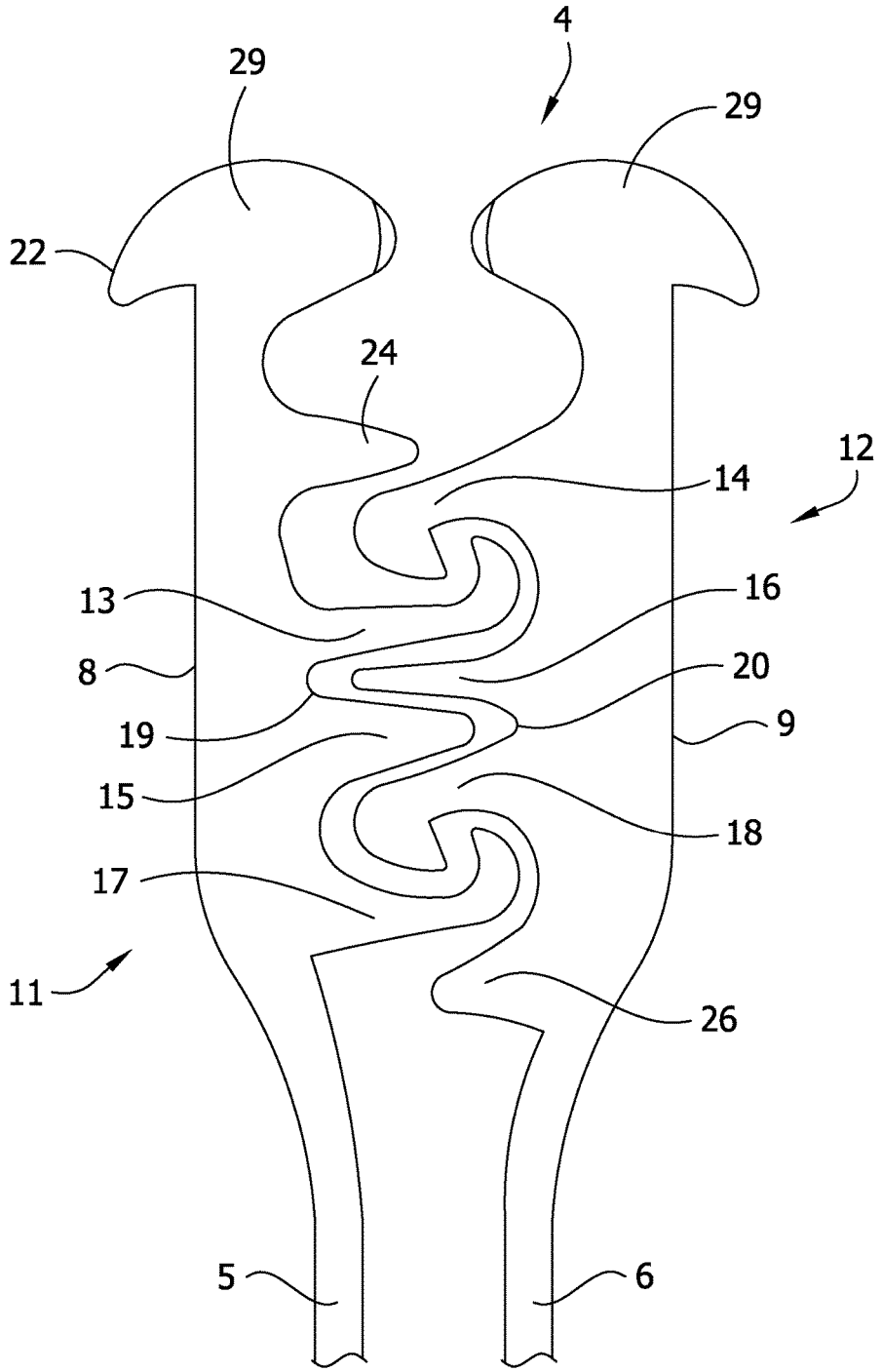
FIG. 2 is an enlarged fragmentary end elevation of a closure of the bag.

In one preferred embodiment, the closure comprises first and second mutually interlocking profiles designated 11 and 12 in FIG. 2, which is an end view of the closure in cross section. These are on the first and second panels 5, 6, respectively. The interlocking profiles comprise a first profile vertical sidewall 8 and a second profile vertical sidewall 9. There are multiple projections 13, 15, and 17 extending laterally from the first profile sidewall 8 toward the second profile vertical sidewall and multiple projections 14, 16, and 18 extending laterally from the second profile sidewall 9 toward the first profile sidewall. The multiple projections comprise a first closure projection 13 on the first interlocking profile 11 which interlocks with a first closure projection 14 on the second interlocking profile 12 when the closure is engaged. There is a sealing projection 15 on the first interlocking profile 11 opposite a sealing channel 20 on the second interlocking profile 12, and a sealing projection 16 on the second interlocking profile 12 opposite a sealing channel 19 on the interlocking profile 11. There is also a second closure projection 17 on the first interlocking profile 11 which interlocks with a second closure projection 18 on the second interlocking profile 12 when the closure is engaged. Here there are illustrated four closure projections (13, 14, 17, 18) and two sealing projections (15, 16); but this arrangement is not narrowly critical. FIG. 2 also shows that closure 4 in the illustrated embodiment has guide members 24 and 26. This particular configuration for the profiles is not critical to the invention and is provided here for exemplary illustrative purposes only.

Figure 3:
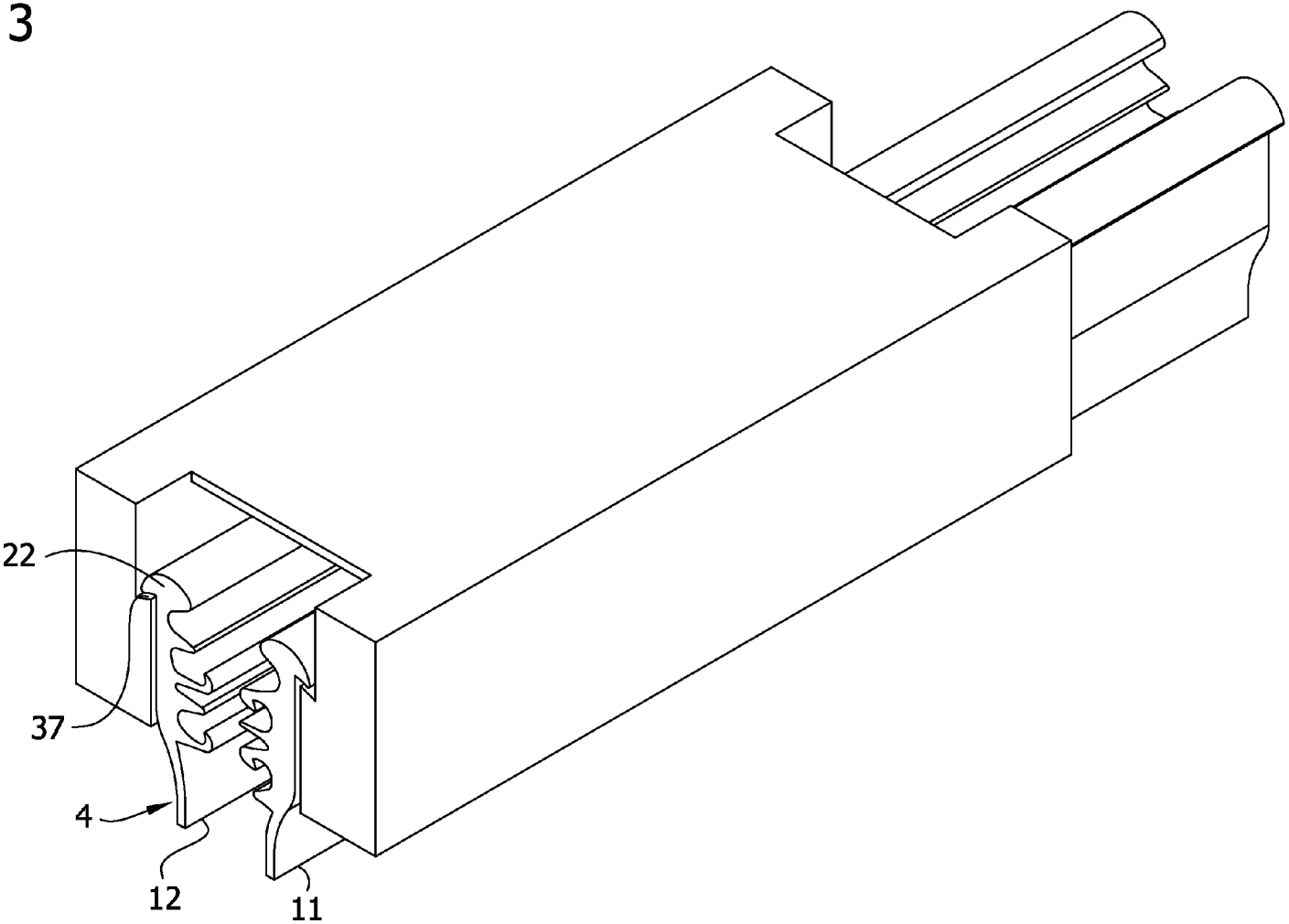
FIG. 3 is a perspective of the closure with a slider mounted thereon.
Figure 4:
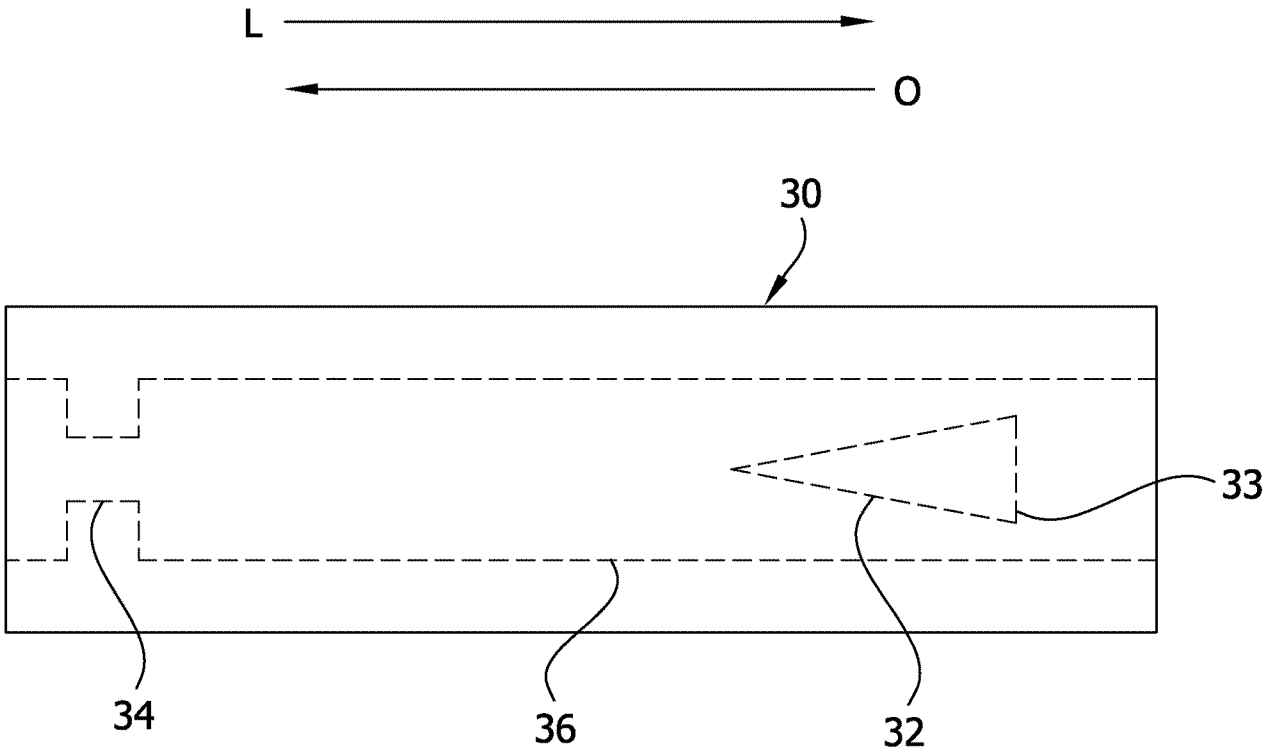
FIG. 4 is a top plan view of the slider illustrating internal parts thereof in phantom.

FIG. 3 is a perspective view of slider 30 on closure 4. As shown in the top view in FIG. 4, the slider 30 has a spreader or opener at 32, shown here in one preferred embodiment in the shape of a wedge, and a constrictor or closer at 34. The slider 30 is adapted to engage the interlocking profiles 11, 12 in locking relationship when the slider is moved across the profiles in a locking direction L and to disengage the interlocking profiles when the slider is moved across the profiles in an opening direction O opposite the locking direction. Constrictor 34 on the slider forces the interlocking profiles 11, 12 together upon sliding the slider 30 in the locking direction L. Spreader 32 on the slider 30 spreads the interlocking profiles 11, 12 apart upon sliding the slider in the opening direction O.

Figure 5:
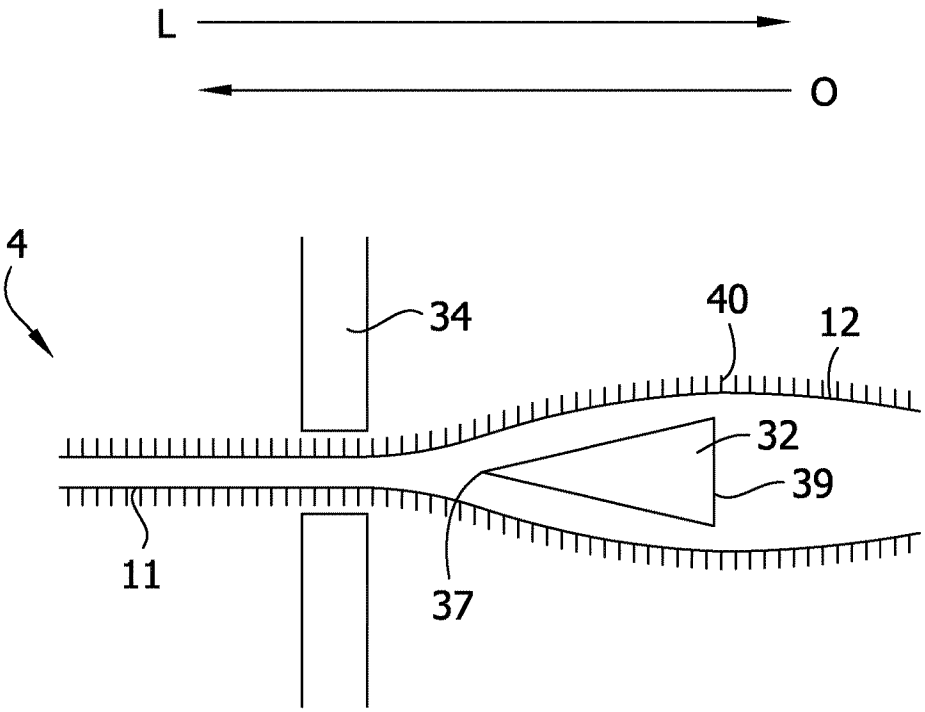
FIG. 5 is a schematic elevation of the slider and closure illustrating the closure received in a constrictor of the slider and a spreader of the slider received between profile members of the closure.

There is a plurality of topographical features spaced periodically along at least one of the profiles 11, 12 which features interfere with sliding of the slider 30 across the profiles and thereby provide a tactile and audible sensation of interference upon sliding. For illustration, these are shown schematically at 40 in FIG. 5 as raised segments. They may also be notched segments or other deformations, for example. One or both of the constrictor 34 and spreader 32 are configured so the sliding in the locking direction L provides a locking tactile and audible sensation which is different from an opening tactile and audible sensation upon sliding in the opening direction O. In this embodiment, the spreader 32 has a first edge 37 pointing toward the constrictor 34 and a second edge 39 pointing away from the constrictor. The first edge 37 is narrower than the second edge 39. In this particular embodiment, the spreader 32 is a wedge and the first edge is a point at 37. The second edge 39 is flat and lies in a plane perpendicular to a sliding direction of the slider, as shown in FIG. 5.

Figure 7:
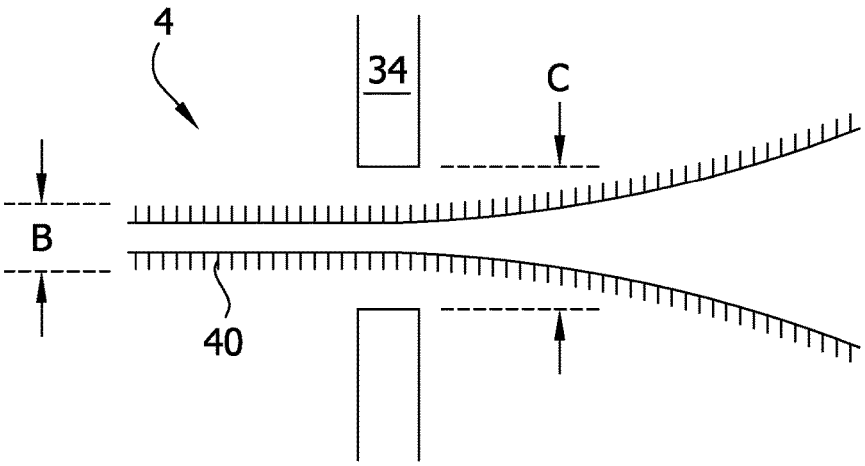
FIG. 7 is is a schematic elevation of a closure received in a constrictor.

FIG. 7 illustrates a dimension B which is the width of the closure when it is in its fully engaged and locked position, and a dimension C which is the width of constrictor 34. The constrictor width C is appreciably greater than the closure width B. In one preferred embodiment, the constrictor width is at least about 10% greater than the closure width B. In another preferred embodiment, the constrictor width is at least about 15% greater than the closure width. This is shown schematically with the difference between the constrictor width and closure width dramatized for visualization. With this greater constrictor width, the topographical features on the closure do not impact the constrictor when the slider is slid to the left in the opening direction, or they impact it with only a very light force. This is one way in which the invention achieves a substantially muted opening tactile and audible sensation, i.e., an opening tactile and audible sensation which is substantially muted in comparison to a locking tactile and audible sensation.

This construction is a marked departure from prior art slider bags with topographical features positioned on the outboard surfaces of the closure profiles for audible/tactile engagement with the constrictor. Such bags that are known to the inventors use closure profiles made from stiffer materials and/or sliders with shorter distances between the constrictor and spreader. As a result, even when the closure is closed, such as when the slider slides in the opening direction, the spreader urges the profiles at least partially open along the distance between the spreader and the constrictor. When the slider slides in the opening direction the constrictor engages the closure profiles where they are held open by the spreader, causing tactile and audible feedback that is not substantially muted in comparison with when the slider slides in the locking direction.

Figure 6:
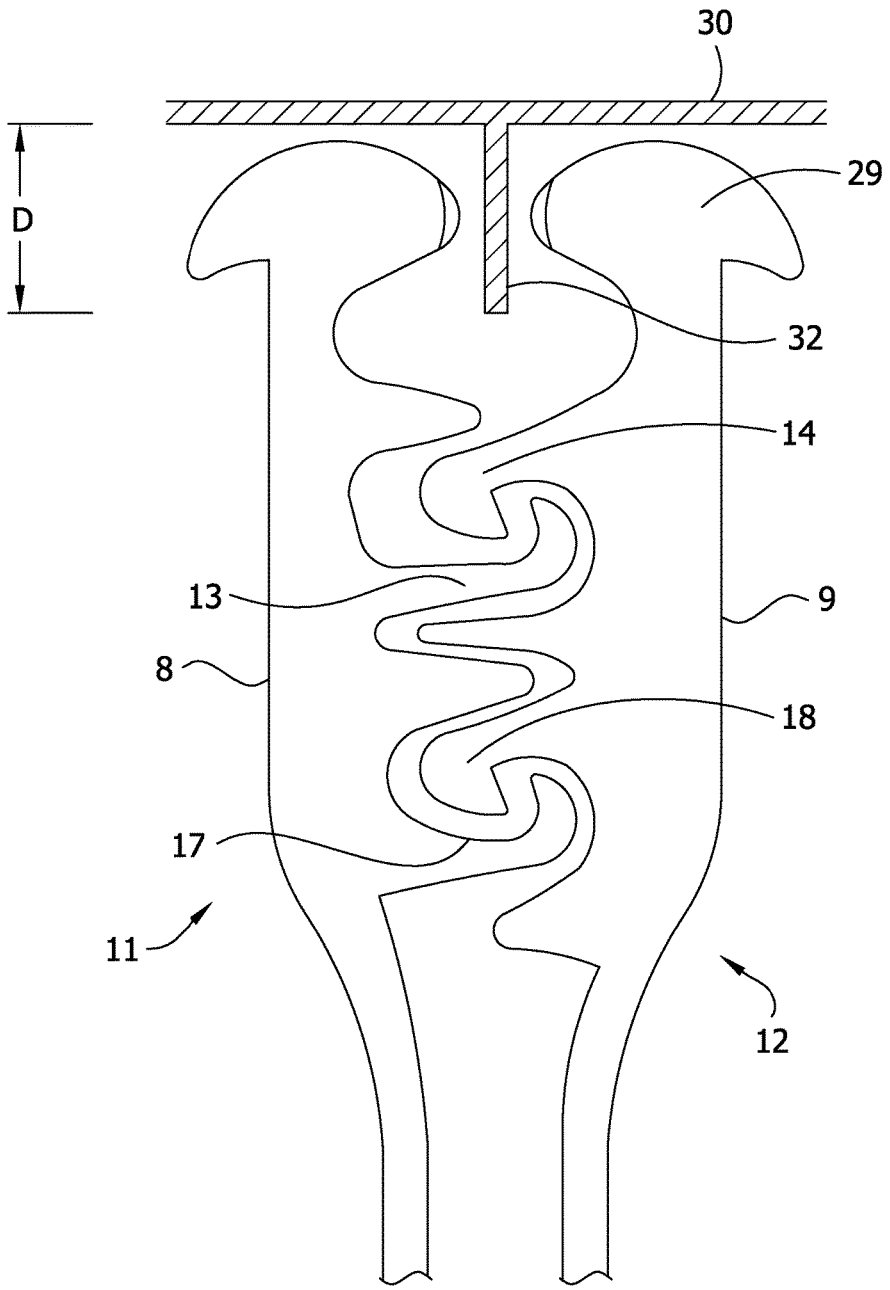
FIG. 6 is a fragmentary cross-sectional end elevation of the slider mounted on the closure.

FIG. 6 shows another way in which the invention can achieve an opening tactile and audible sensation which is substantially muted in comparison to a locking tactile and audible sensation. This is a head-on cross-sectional view oriented such that the slider 30 would slide in and out of the page. The spreader 32 has a depth D which terminates above the uppermost closure projections 13 and 14. That is, the spreader therefore operates only directly on shoulders 29 and does not contact any of the projections that extend inward from the vertical sidewalls 8, 9. This is in contrast to prior art designs with a much deeper spreader which acts directly on the closure or locking elements such as 13 and 14. The much shallower spreader 32 of one or more embodiments of the invention opens the closure much more gently by separating the shoulders 29, which causes the locking elements/closure projections 13, 14 to be gently pulled apart, in an action which is more passive than directly spreading them with impact from the spreader. This promotes a tactile and audible sensation which is tempered or muted in comparison to that where a much deeper spreader is used. This also promotes an opening action by which the profiles 11, 12 are not separated as much, and therefore topographical features on the outwardly facing surfaces of the profiles impact the constriction 34 less or even not at all as the slider 30 moves in the opening direction O. By comparison, when the slider moves in the locking direction L, the user will have typically opened the closure panels 11, 12 more widely than is accomplished by the action of the spreader 32 alone. As a result, when the moves the spreader in the locking direction L to close the closure 4, the constrictor 32 will more firmly engage the outwardly facing edges of the profiles 11, 12 and thereby produce audible and tactile feedback that is more pronounced in comparison with the slider sliding in the opening direction O to open the closure.

Figure 8:
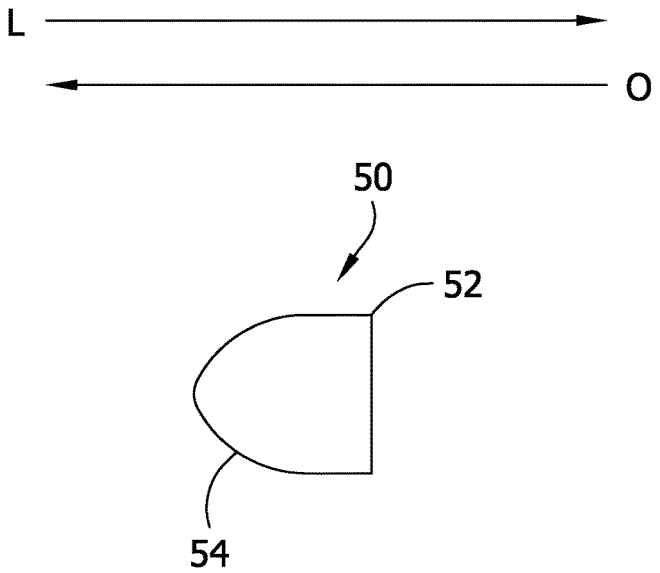
FIG. 8 is a plan view of another embodiment of a spreader.
Figure 9:
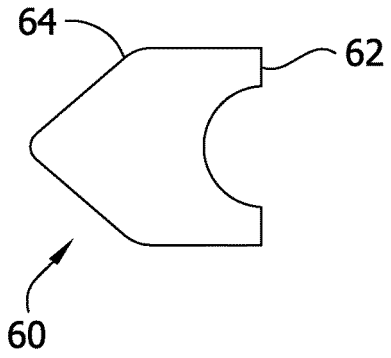
FIG. 9 is a plan view of another embodiment of a spreader.

FIGS. 8 and 9 illustrate alternative embodiments of a spreader. Spreader 50 in FIG. 8 has a sharp edge 52 which is adapted in the context of the overall apparatus to impact the topographical features upon sliding the slider in the closing or locking direction L. The spreader 50 also has rounded edge 54 which is adapted in the context of the overall apparatus to impact the topographical features upon sliding the slider in the opening direction O. This spreader 50 impacts topographical features on the closure 4, such as inwardly facing topographical features in contrast to the outwardly facing topographical features of FIG. 5. The sharp edge or corner 52 is a leading edge which impacts the features with substantially greater impact force when sliding in the locking direction L than does the rounded edge 54, which is the leading edge when sliding in the opening direction O. An alternative spreader configuration is shown at 60 in FIG. 9, with sharp edge or corner 62 and rounded edge 64.

The topographical features in one embodiment are positioned on the outwardly facing surface of one or both of the profiles 11, 12, as illustrated schematically in FIG. 5 at 40. In this arrangement, the features impact the constrictor 34 to produce the desired tactile and audible feedback. Alternatively, the topographical features may be positioned on an inwardly facing surface of one or both profiles 11, 12 and thereby be adapted to impact the spreader 32 to produce the desired tactile and audible feedback.

Figure 10:
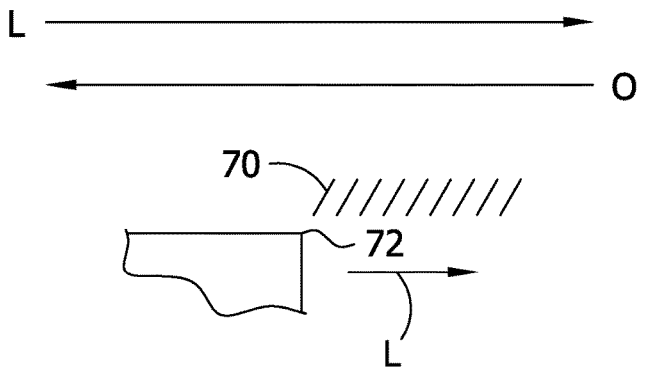
FIG. 10 is a fragmentary schematic plan view of a sharp edge of a spreader and topographical features of one of the profiles of the closure.
Figure 11:
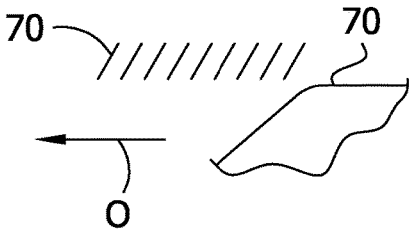
FIG. 11 is a fragmentary schematic plan view of a rounded edge of the spreader and the topographical features.

In a further variation, the topographical features may be aligned as shown at 70 in FIGS. 10 and 11 such that they are at an acute angle relative to the locking direction L as shown in FIG. 10 and at an obtuse angle relative to the opening direction O shown in FIG. 11. With, upon closing, the topographical features at an acute angle impacting a sharp edge at 72 of a spreader as shown in FIG. 10, the impact is significantly more pronounced than is impact upon opening, as shown in FIG. 11, where the impact is dampened by the feature angle and by the dull corner 74. In this way, the closure mechanism manifests a locking tactile and audible sensation upon closing which is different from an opening tactile and audible sensation upon sliding in the opening direction. This may be arranged so that the sensations are greater upon closing than upon opening, or vice versa. In the currently preferred embodiment, it is arranged so the sensations are greater upon closing than upon opening, to provide consumers tactile and audible assurance that the bag is closed, while still providing the different sensations that permit the user to distinguish between opening and closing.

In a further aspect of the invention, the slider and or profiles, or at least impact areas of the profiles, are manufactured from a relatively softer material to further temper the tactile and audible sensation manifest by opening the bag.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

The invention claimed is:

1. A plastic bag comprising:

a first panel;

a second panel, the first panel and second panel defining a bag interior and an opening at an end margin of the first and second panels to permit access to the bag interior;

a closure at the opening comprising first and second mutually interlocking profiles on the first and second panels, respectively;

a slider on the closure adapted to engage the interlocking profiles in locking relationship when the slider is moved across the profiles in a locking direction and to disengage the interlocking profiles when the slider is moved across the profiles in an opening direction opposite the locking direction;

a constrictor on the slider for forcing the interlocking profiles together upon sliding the slider in the locking direction;

a spreader on the slider for spreading the interlocking profiles apart upon sliding the slider in the opening direction;

a plurality of topographical features spaced periodically along at least one of the profiles which features interfere with sliding of the slider across the profiles and thereby provide a tactile and audible sensation of interference upon sliding;

the topographical features are aligned at an angle which is acute relative to the locking direction and obtuse relative to the opening direction such that the spreader encounters a different alignment of topographical features moving in the locking direction than in the opening direction to thereby manifest a locking tactile and audible sensation upon closing which is greater than an opening tactile and audible sensation upon sliding in the opening direction; and wherein the spreader has a flat leading edge intersecting straight side wall edges at right angle corners, wherein the flat leading edge faces in the locking direction and is adapted to impact the topographical features when the slider is moved in the locking direction, and a rounded leading edge facing in the opening direction and adapted to impact the topographical features when the slider is moved in the opening direction, wherein the rounded leading edge terminates at the straight side wall edges that form the right angle corners with the flat leading edge.

2. The plastic bag of claim 1 wherein:

the constrictor has a constrictor width;

the closure has a closure width when the interlocking profiles are engaged in locking relationship;

and the constrictor width is greater than the closure width.

3. The plastic bag of claim 2 wherein the constrictor width is at least about 10% greater than the closure width.

4. The plastic bag of claim 1 wherein the spreader has a soft portion comprising a soft material and a hard portion comprising a hard material that is harder than the soft material, the soft portion of the spreader forming the rounded edge and the hard portion of the spreader forming the sharp edge.

5. The plastic bag of claim 1 the interlocking profiles have interlocking closure projections and the closure further comprises inwardly projecting shoulders above each of the mutually interlocking profiles; and the spreader has a depth which terminates above the interlocking closure projections such that the spreader depends between the shoulders and does not depend between the interlocking closure projections.

6. The plastic bag of claim 5 wherein the opening tactile and audible sensation is muted in comparison with the locking tactile and audible sensation.

* * * * *